United States Patent [19]

Moores

[11] Patent Number: 4,587,934

[45] Date of Patent: May 13, 1986

[54] VARIABLE-TIMING VALVE ACTUATING MECHANISM

[76] Inventor: Keith J. Moores, P.O. Box 10, Apopka, Fla. 32703

[21] Appl. No.: 495,073

[22] Filed: May 16, 1983

[51] Int. Cl.[4] ..... F01L 1/08

[52] U.S. Cl. ..... 123/90.18; 123/90.44

[58] Field of Search ..... 123/90.17, 90.18, 90.44, 123/90.16

[56] References Cited

U.S. PATENT DOCUMENTS

| | | | |
|---|---|---|---|
| 1,691,991 | 11/1928 | Puckett | 123/90.44 |
| 2,060,580 | 11/1936 | La Chapelle | 123/90.18 |
| 2,980,089 | 4/1961 | Sampietro | 123/90.18 X |
| 3,401,572 | 9/1968 | Bailey | 123/90.18 X |
| 3,481,314 | 12/1969 | Crenn | 123/90.18 |
| 4,151,817 | 5/1979 | Mueller | 123/90.16 |

*Primary Examiner*—William R. Cline
*Assistant Examiner*—Peggy Neils

[57] ABSTRACT

A variable-timing valve actuating mechanism for an internal combustion engine having an axially movable cam shaft, movable by a governor device to a position proportional to engine rpm. A set of dual cams is provided for operating intake and exhaust valves with a uniform profile lobe effective only over an idle to medium rpm range and a non-uniform profile lobe effective only over a medium to maximum rpm range. A timing gear drives the cam shaft and utilizes a spiral spine drive to also advance and retard the cam shaft rotation proportional to the cam shaft axial position. The variable advance/retard action and the non-uniform cam lobe are selected to optimize valve overlap, valve opening angle, and valve timing as a function of rpm.

4 Claims, 8 Drawing Figures

VARIABLE-TIMING VALVE ACTUATING MECHANISM

BACKGROUND OF THE INVENTION

1. Field of the Invention

This invention relates generally to adjustable cam and cam followers, and particularly to engine valve mechanisms for internal combustion engines which are controlled to maximize the efficiency of the engine.

2. Description of the Prior Art

The present day automobile engines are generally designed to provide the maximum efficiency at a high load. Among the variable design parameters are the timing of the intake and exhaust valves. These valves are commonly operated from a cam shaft having fixed cams with the timing selected to optimize the performance of the engine at a selected load. It is also well known that the timing requirements differ for various loads and therefore a fixed valve timing system will give optimum performance at only one load. The valve timing also has an effect on the emission characteristics of the engine and the usual fixed timing mechanism does not provide the best emission characteristics.

Therefore, it is clear that if the opening and closing of the valve could be varied with the load on the engine, more efficient operation would be obtained and the fuel economy improved.

The optimum opening and closing points as well as the overlap between exhaust and intake valves vary with load and therefore it is desirable to provide valve operating mechanisms which can optimize these events.

The need for variable valve timing has been known for many years and a large number of attempts have been made to provide effective means for this purpose. One technique that has been explored involves the use of a cam shaft which may be xoved axially and which includes cams with axially varying lobes. Means are provided to move the cam shaft axially in accordance with the rpm or the load on the engine. The cam shaft lobe is then shaped to provide the optimum valve operating parameters for the corresponding load condition. The following U.S. patents describe various mechanisms utilizing an axially movable cam shaft:

| | |
|---|---|
| U.S. Pat. No. 2,307,926 | Griffith, et al |
| U.S. Pat. No. 3,618,573 | Allen |
| U.S. Pat. No. 3,618,574 | Miller |
| U.S. Pat. No. 3,633,554 | Nakajima, et al |
| U.S. Pat. No. 3,638,624 | O'Grady |
| U.S. Pat. No. 3,730,150 | Godner, Jr. |
| U.S. Pat. No. 3,897,760 | Hisserich |
| U.S. Pat. No. 3,915,129 | Rust, et al |
| U.S. Pat. No. 3,945,355 | Calvaic |
| U.S. Pat. No. 3,986,484 | Dyer |
| U.S. Pat. No. 4,182,289 | Nakajima |

Although the axially sliding cam shaft is a workable approach to the problem, one serious disadvantage present in most of the above-listed patents is the necessity of having the cam follower move along the variable lobe of the cams. This generally necessitates a point contact at which point very high pressures occur during engine operation, resulting in rapid wear and eventual failure. For example in the Griffith, et al patent, a rolling ball is utilized which produces basically a point contact. O'Grady shows a valve having a rounded end which also makes a small contact with the load.

The patent to Rust teaches a ball contact with a flattened portion to attempt to provide a line of contact with the cam lobe face. The patents to Allen and Miller show a rocking follower to solve this problem.

Another problem relates to the necessity of providing a single cam for each valve that has a complex contour to obtain a desired advance in the lower rpm of the engine while maintaining the same valve overlap while attempting to provide a line contact between the lobes and the cam followers.

SUMMARY OF THE INVENTION

The present invention provides a cam shaft which is movable axially by means of a simple centrifugal governor. Each valve includes a novel double cam with one portion having a uniform lobe and an adjacent portion having a variable lobe which greatly simplifies the cam design for low rpm. The variable lobe portion necessarily includes an angular surface in which the operative portions vary axially to be able to change the timing of the closing angle and the rate of closing of the associated valve both with respect to a reference point such as top dead center and with reference to the other valve in that cylinder. A novel rocker arm is provided having a pair of cam followers associated with each arm. A first surface of the arm is parallel with the fixed cam surface of the dual cam and includes a semi-circular recess for accepting a cam follower in the shape of a disc. The disc is captivated in the recess by a pin such that as the cam shaft rotates, the disc makes a line contact therewith around its rim or periphery and also rotates within the semi-circular recess of the rocker arm. Thus, not only is the contact point a line contact but also is continuously changing to prevent or minimize wear. As the cam shaft moves laterally no change in valve opening periods occurs as the uniform cam moves across the cam follower. However, a spline having a slight spiral is provided in the coupling between the timing gear and the cam shaft. Thus, when the cam shaft moves laterally, the spiral spline causes an advance in the cam timing of intake and exhaust valves simultaneously. A second surface is provided on the rocker arm which is at an angle with respect to the first surface. This surface is parallel to the angled surface of the second cam portion. A similar semi-circular recess is provided in the slanted surface with a disc type cam follower captivated therein with the disc extending normal to the slanted surface. As the cam moves laterally with an increase of r.p.m., the second cam follower contacts the angled cam lobe during the closing cycle of the valve thereby controlling the timing and rate of closure thereof.

As may now be recognized, the second cam follower will have an outside rim or periphery parallel with the variable cam. As the cam shaft moves laterally, at a selected point in its movement, the canted cam follower will contact the surface causing the control of the valve opening to be determined by the shape and height of the variable cam. Due to the canting of the cam follower, a line contact is made with the variable cam face and the disc cam follower rotates in its recess to again minimize wear.

It is to be understood that at the point of transition of control of the valve closing from the uniform lobe cam and first cam follower to the variable lobe cam and second cam follower, the lift of each cam is identical and each follower is engaged with its respective cam to provide a smooth transition.

The shape of the variable lobe cam is determined by the particular engine in which the invention is to be used. The uniform lobed cam is effective during low rpm conditions and results in a minimum of valve overlap and a minimum duration of the open valve condition. The variable lobe cam is generally formed to increase the time of opening of the valve as the rpm is increased to permit increased fuel air charge to enter the combustion chamber and the overlap increases to ensure complete scavenging of the combustion chamber on the exhaust strobe and to prevent unburned residues from being discharged into the atmosphere.

It is therefore a principle object of the invention to provide a variable cam mechanism for internal combustion engines in which a valve is opened by a uniform cam lobe and closed by a variable cam lobe and in which the rate of closing is optimized as a function of engine r.p.m.

It is another object of the invention to provide a valve operating mechanism having a uniform shaped cam adjacent to a variable lobe cam for each valve in the engine.

It is yet another object of the invention to provide a rocker arm having a first flat surface parallel with the uniform cam and a second flat surface at an angle with the first flat surface and parallel to the variable cam face.

It is still another object of the invention to provide a disc shaped cam follower recessed in a semi-circular recess in each of the flat surfaces of the rocker arm in which the slanted surface cam follower has its periphery parallel to the variable cam lobe face and the first flat surface cam follower has its periphery parallel to the uniform cam lobe face.

It is a further object of the invention to provide a centrifugal governor for sliding the cam shaft of the valve mechanism axially for a distance proportional to the rpm of the associated engine.

It is yet a further object of the invention to provide an axially movable cam shaft in which the times of opening of exhaust and intake valves are automatically advanced as the rpm of the engine increases.

These and other objects and advantages of the invention will become apparent from the following detailed description and drawings.

DETAILED DESCRIPTION OF THE PREFERRED EMBODIMENT

Figure 1:
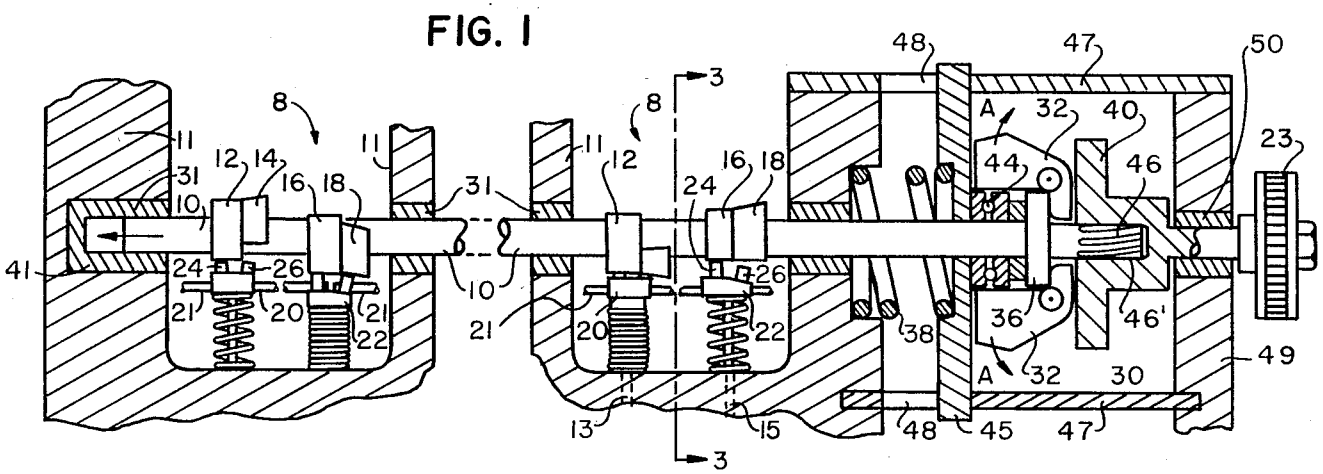
FIG. 1 is a partial cross sectional view of an overhead valve internal combustion engine having the valve mechanism of the invention installed therein.

The valve mechanism of the present invention is applicable to a wide range of types of internal combustion engines as will be apparent to those of skill in the art. For purposes of explanation, the application to an overhead valve type engine will be utilized. Turning to FIG. 1, a partial cross sectional view of the cam shaft mechanism and portions of the cylinder head of an overhead valve internal combustion engine is shown to illustrate certain aspects of the invention. A cam shaft 10 is provided disposed in bearings 31 in ribs 11. Cam shaft 10 rotates in bearings 31 and is also axially movable in bearings 31 as indicated by arrow B. As shown, cam shaft 10 is in its at rest position.

This position is maintained by compression spring 38 exerting pressure to the right on governor plate 45 against thrust bearing 44 and governor disk 36. A centrifugal governor shown generally at 30 is mounted to driving member 40 having weight 32 which will move outward, as indicated by arrows A, when governor assembly 30 is rotated. Driving member 40 is supported in end piece 49 by bearing 43. Driving member 40 is driven by cam shaft timing gear or sprocket 23, operated by a conventional cam shaft drive train. Member 40 includes internal spline 46' concentric with timing gear 23 which mates with an external spline 46 at the right end of cam shaft 10. As will be understood, cam shaft 10 in FIG. 1 is slidably coupled to internal spline 46' of driving member 40 and can move to the left as indicated by arrow B. Splines 46 and 46' have a spiral twist such that the movement of cam 10 in direction B causes the relative rotation of cam shaft 10 to advance with respect to the at-rest postion. When governor 30 rotates, weights 32 move outward as indicated by arrows A and force governor disk 36 to the left, moving shaft as indicated by arrow B.

A double cam 12, 14 is associated with one valve of each cylinder 8 and double cam 16, 18 is associated with the other valve of each cylinder 8. Cams 12 and 16 have uniform lobes as best seen in the perspective view of FIG. 5. Cams 14 and 18, on the other hand, have a lobe whose shape varies axially such that the points at which the associated valves open and close varies according to the position of cam shaft 10.

Figure 2:
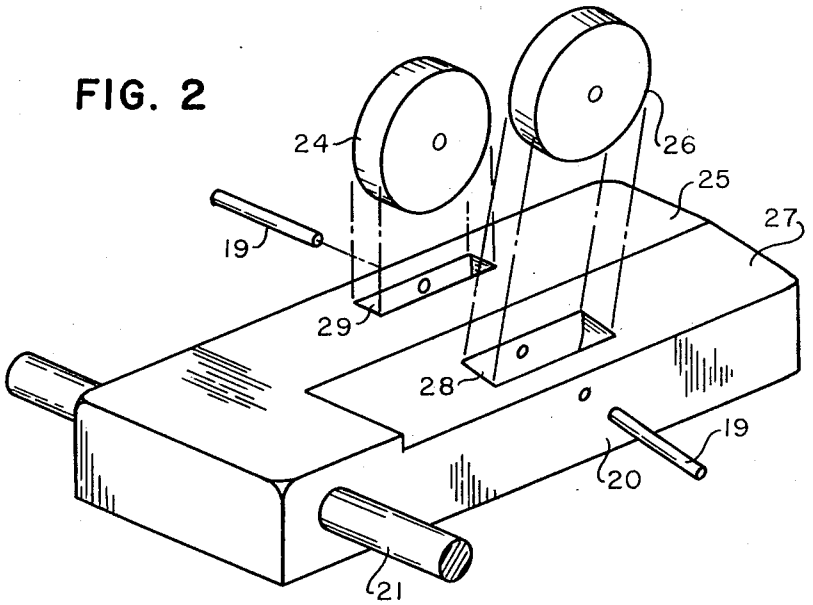
FIG. 2 is a perspective view of a rocker arm of the mechanism of FIG. 1 showing the mounting of the disc type cam followers.

Referring to FIG. 2, a perspective view of a rocker arm in accordance with the invention is shown. Rocker arm 20 is pivoted on shaft 21 at one end and the underside of the opposite end is recessed (not shown) to contact the valve end of its associated valve. Rocker arm 20 includes a horizontal flat upper surface 25 having semi-circular recess 29 therein. Recess 29 is perpindicular to surface 25 and is of a size to accept a hard steel disc-shaped cam follower 24 which is free to rotate within recess 29. The peripheral edge of follower 24 contacts uniform lobe cam 12 at its left edge for the example of FIG. 1. As may be noted, cam 12 will contact cam follower 24 along a line and as cam 12 rotates, follower 24 will also have a tendency to rotate. A second portion of the top surface of rocker arm 20 includes a sloping or canted face 27 having a semi-circular recess 28 therein. A second cam follower 26 is disposed in recess 28 normal to canted surface 27. Cam followers 24, 26 may be captivated in recesses 29, 28 by pins 19, such that cam pressure acts on recesses 29, 28 rather than pins 19. The angle of surface 27 is selected to be the same as the angle of second cam 14. Rocker arm 22 is essentially the same as rocker arm 20, although in some applications the angled surface could have a different angle than surface 27.

Figure 3:
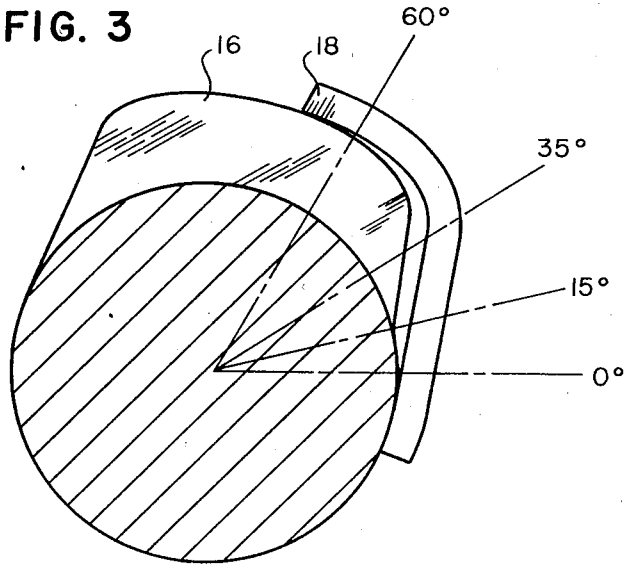
FIG. 3 is a cross section view of the cam shaft of FIG. 1 showing end views of the fixed lobe cam and the adjacent variable lobe cam for a particular example.

It is evident that the exact designs of cams 12, 14, 16 and 18 are dependent on the size and type of internal combustion engine with which the invention is to be used, and will be a function of the optimum overlap and opening times of the valves for various rpm's of the engine. However, FIG. 3 shows a typical design for cams 16 and 18 by means of a cross sectional view 3—3 of shaft 10. As may be seen, cam 16 is uniform while cam 18 slopes outward from its junction with cam 16.

Figures 4A, 4B, 4C:
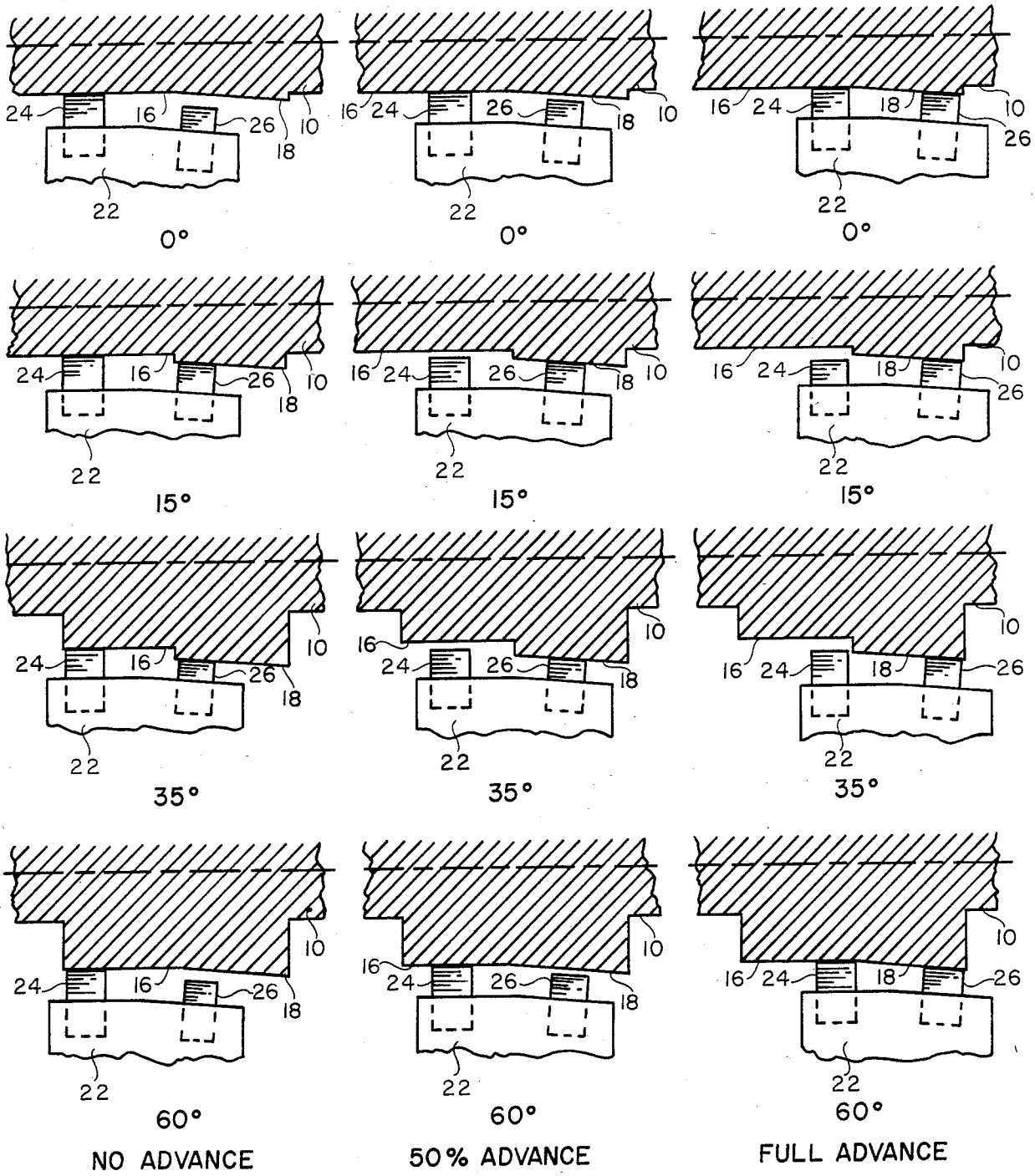
FIG. 4*a* is a cross sectional view of the cam shaft of FIG. 1 for the four different reference angles of FIG. 3 for the low speed or no advance position of the cam shaft.
FIG. 4*b* shows the views of FIG. 4*a* but for a 50% advance movement of the cam shaft.
FIG. 4*c* shows the views of FIG. 4*a* but for the maximum advance of the crankshaft.

Referring to FIGS. 4*a*, 4*b*, and 4*c*, the exemplary cam construction of FIG. 3 will be used to illustrate a typical operation of the cams of FIG. 1. FIG. 4*a* shows a cross section of shaft 10 through cams 16 and 18 for the four angles 0°, 15°, 35°, and 60°, indicated in FIG. 3. The views of FIGS. 4*a* are for the position of cam shaft 10 shown in FIG. 1 for the very low or idle rpm condition. In this position, the valve associated with rocker arm 22 is controlled entirely by cam 16 since cam follower 24 is in contact over the entire range of angles shown while cam follower 26 just contacts cam 18 over the range of about 15° to 35° and does not form contact over other portions of the rotation. FIG. 4*b* indicates the situation when a medium rpm has been achieved and governor 30 has been effective in shifting cam shaft 10 axially for about 50% of its maximum or full advance. Here it may be noted that cam 16 is controlling at the 0° and 60° points while cam 18 is controlling in the 15° to 35° region. At maximum rpm, the full advance condition illustrated in FIG. 4*c* is achieved at which point the valve is controlled entirely by cam 18 and cam follower 26 which is in contact over the entire range shown. Thus, cam 16 is ineffective in the full advance position.

In general, it is required to have a valve open for a greater portion of the stroke cycle at high rpm than at low rpm. Similarly, it is generally required to provide a greater overlap between the open time of the intake valve and the open time of the exhaust valve at the higher rpm's.

Figure 5:
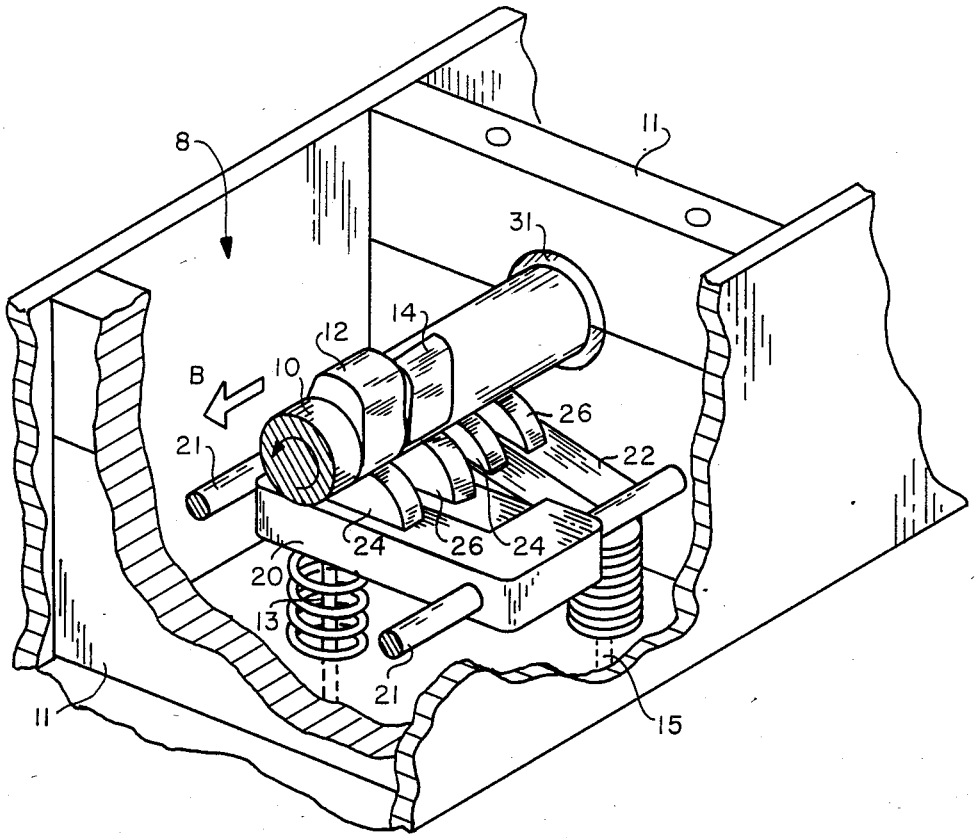
FIG. 5 is a cut away perspective view of a typical intake and exhaust valve arrangement for an overhead valve engine showing one valve in the operated position and the other valve in the closed position.

As previously mentioned, the novel cam and cam follower construction may be utilized with various types of valve mechanisms and is not limited to the overhead valve configuration in the examples shown herein. In FIG. 5, an example of the construction of an overhead cam valve mechanism is shown in the partially cut away view. Valve 13 shown is operated by rocker arm 20 which is pivoted on shaft 21. Cam shaft 10 is in the low rpm position which would be to the right in the illustration and valve 13 is closed. Cam follower 24 is therefore contacting the lowest surface of cam 12 and canted follower 26 is not making contact with cam 14.

Valve 15 is in the open position with rocker arm 22 being forced downward by cam 16 in contact with cam follower 24. Since cam shaft 10 is in the low rpm position, canted follower 26 is not depressed by cam 18. However, when the rpm of the engine is increased, shaft 10 will move in the direction shown by arrow B, sliding in bushing 31, which will result in cams 14 and 18 being effective to operate their respective canted cam followers 26.

Figure 6:
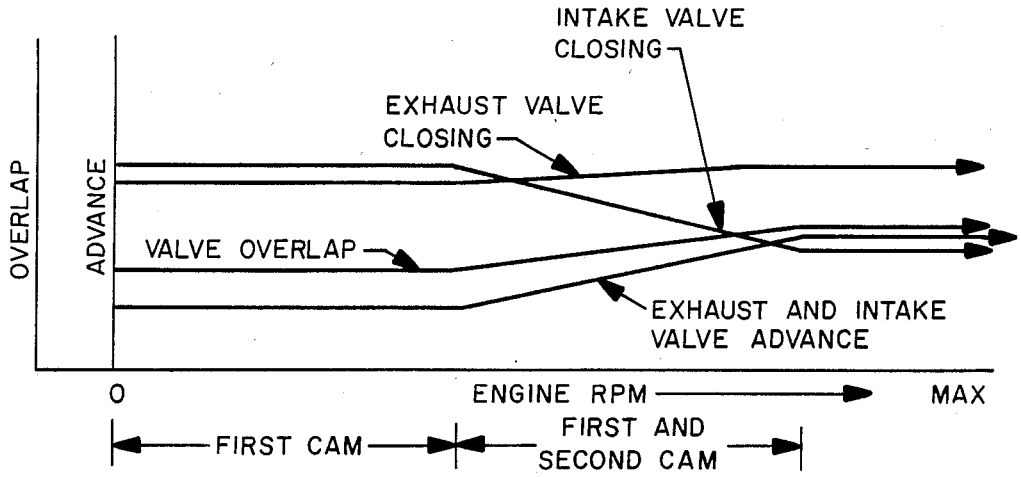
FIG. 6 is a graph of valve overlap, opening angle, and advance angle as a function of engine rpm as compared to a conventional engine.

The flexibility and controllability provided by my invention may be noted from FIG. 6 which illustrates the variations in timing for an exemplary engine. Changes in valve overlap, exhaust valve advance, intake valve advance, exhaust valve opening angle, and intake valve opening angle are plotted versus engine rpm.

For low rpm, the first uniform cam is effective for valve timing, and valve overlap and valve opening angles will be constant. However, the exhaust and intake opening times will advance with rpm equally due to the cam shaft advance by virtue of the sprial spline drive. As the valve operation is transferred to the second cam for medium and high rpm operation, the intake and exhaust valve operations are independetnly controlled since the slopes of the second cams can be optimized with respect to exhaust and intake valves. For example, the intake valve second cam lobe may have a greater slope than the exhaust valve second cam lobe producing a greater advance of the intake valve with rpm. Similarly, the circumferential length of the high portion of the intake valve second cam lobe for maximum rpm can be greater than for the exhaust valve second cam lobe. This design would produce a larger opening angle as shown. Thus, my invention provides the designer with the freedom to optimize the engine efficiency over the entire operating range of the engine. By contrast, a prior art fixed cam engine can have only one value for each of the above referenced parameters.

A variable timing valve mechanism for an internal combustion engine has been disclosed having a cam shaft with dual-lobed cams in which one lobe is uniform and the other lobe has an axially varying shape, the cam shaft being axially shiftable as a function of rpm. A rocker arm having dual cam followers is provided for each dual-lobed cam, the cam followers adapted to make a line contact with the associated cam lobe faces to minimize wear and galling. The cam followers are advantageously disc shaped and are adapted to rotate in use for further reduction in wear. A spiral drive spline for the cam shaft causes a linear advance of valve timing with engine rpm.

Although the invention has been described with reference to a specific design and implementation, it will be obvious to those of skill in the art that any number of variations can be made without departing from the spirit or scope of the invention.

I claim:

1. In an internal combustion engine having a plurality of valves and a crank shaft, the valve actuating apparatus comprising:

cam shaft bearing means;

a cam shaft rotatably and slidably disposed in said bearing means and adapted to be movable axially, said shaft having a set of external spiral splines at one end thereof;

timing gear means driven from the engine crank shaft including a timing gear and a cam shaft driving member, said driving member having a set of internal spiral splines coupled to said external spiral splines of said cam shaft, said timing gear means serving to rotate said cam shaft;

a plurality of dual cams disposed along said cam shaft, one of said dual cams associated with each of the valves, each of said dual cams having a first cam portion having a uniform axial camming surface profile and a second cam portion having a non-uniform axial camming surface profile;

a plurality of rocker arms with one of said rocker arms operatively associated with each valve and each of said dual cams, each of said rocker arms having a first cam follower for contacting said first cam portion and a second cam follower for contacting said second cam portion, each of said rocker arms including a body portion having a generally horizontal first surface and a second surface at a small angle to said first surface, a generally semi-circular recess in said first surface for holding said first cam follower, and a generally semi-circular recess in said second surface for holding said second cam follower, each of said first and second cam followers including a generally circular disk, and a retaining pin for retaining said disk in said recess, said first and second surfaces of said rocker arms disposed to provide a rolling line contact between said cam followers and said camming surfaces, and operative contact between said cam followers and respective ones of said recesses;

governor means attached to said driving member and coupled to said cam shaft for moving said cam shaft axially in said bearing means to a position proportional to the rpm of said engine, such movement of said cam shaft causing said spiral splines to thereby advance or retard the rotational position of said cam shaft causing the point of opening of each of said valves to advance or retard, said first cam follower adapted to contact said first cam portion for 360° only over a range of rpm from low to medium and said second cam follower adapted to operatively contact said second cam portion only over a range of rpm from medium to maximum, said non-uniform profile of said second cam portion selected to provide optimum valve overlap, optimum intake opening angle, optimum exhaust valve opening angle, optimum intake valve timing, and optimum exhaust valve timing for the internal combustion engine over said medium to maximum rpm range.

2. In an internal combustion engine having a plurality of valves and a crankshaft, the valve actuating apparatus comprising:

camshaft bearings;

camshaft rotatably and axially slidably disposed in said bearings, said camshaft having a set of external spiral splines at one end thereof;

timing gear means driven from the engine crankshaft and having a set of internal spiral splines coupled to said external spiral splines of said camshaft, said timing gear means serving to rotate said camshaft;

camshaft moving means for moving said camshaft axially to a selected position proportional to the r.p.m. of the internal combustion engine;

a plurality of dual contiguous cams disposed along said camshaft, one of said dual cams associated with each of the valves, each of said dual cams having a first cam having a uniform camming surface axial profile and a contiguous second cam having a profile which is non-uniform axially and increasing in radius axially from said first cam;

a plurality of rocker arms with one of said arms operatively associated with each valve and each one of said dual cams, each of said rocker arms having a body portion having a generally horizontal first surface essentially parallel to said first cam surface and a second surface at a small angle to said first surface and essentially parallel to said second cam surface; and a first semi-circular recess in said surface for holding a first cam follower, and a second semi-circular recess in said surface for holding a second cam follower, first and second cam followers disposed in said first and second recesses each comprising a generally circular disc, and a retaining pin for retaining said disc in said recess, wherein said first cam follower is in line contact with said first cam surface and operative to open and close said associated valve during low rpm operation of said engine and to also open said associated valve during medium to high rpm operation of said engine and said second cam follower is in line contact with said second cam surface and operative to close said associated valve during medium to high rpm operation of said engine;

said profile of each of said second cams selected to provide optimum valve overlap, optimum intake rate of closure, optimum exhaust valve closing angle, optimum intake valve closing timing, and optimum exhaust valve closing timing for the internal combustion engine over said medium to high rpm range.

3. The apparatus as defined in claim 2, in which said camshaft moving means includes:

a centrifugal governor drive from said engine crankshaft and having a coupling coupled to said camshaft for moving said camshaft axially in said bearings to a position proportional to the rpm of said engine, such movement of said camshaft being independent of said timing gear means thereby advancing or retarding the rotation of said camshaft causing the point of opening and closing of each of said valves to advance or retard.

4. The apparatus as defined in claim 3 in which said coupling includes:

a compression spring for biasing said camshaft in a starting position when said governor is operating at a minimum rpm;

a thrust bearing; and a governor plate operatively connected to said governor for moving said camshaft against said spring as said governor operates at a higher than minimum rpm.

* * * * *